United States Patent [19]

Wood

[11] 4,015,255

[45] Mar. 29, 1977

[54] MAGNETICALLY OPERATED SIGN

[75] Inventor: Keith S. Wood, Danville, Ill.

[73] Assignee: Time-O-Matic, Inc., Danville, Ill.

[22] Filed: June 25, 1975

[21] Appl. No.: 590,322

[52] U.S. Cl. ..... 340/373; 340/381

[51] Int. Cl.[2] ..... G08B 5/24

[58] Field of Search ..... 340/373, 381

[56] References Cited

UNITED STATES PATENTS

| | | | |
|---|---|---|---|
| 3,140,553 | 7/1964 | Taylor | 340/373 |
| 3,469,258 | 9/1969 | Winrow | 340/373 |
| 3,518,664 | 6/1970 | Taylor | 340/373 |
| 3,540,038 | 11/1970 | Taylor | 340/373 |

*Primary Examiner*—Harold Pitts
*Attorney, Agent, or Firm*—Wallenstein, Spangenberg, Hattis & Strampel

[57] ABSTRACT

A sign includes a frame having an upwardly and outwardly extending lip. Laterally spaced digit-forming indicating assemblies each having a hook-shaped upper portion are engaged over the lip of the frame and anchored in place on the frame by screw means or the like at the bottom portions thereof. Each indicating assembly preferably includes a vertical panel made of a material of low magnetic reluctance and supporting on the front face thereof vertically spaced horizontal rows of electromagnets each including a single core leg projecting transversely from the front of the panel and horizontally extending vertically spaced pivot pins offset slightly upwardly from the center lines of the rows of core legs. A number of preferably annular permanent magnets are supported on each pivot pin opposite the core legs and spaced horizontally therealong. An indicating disc is secured to each permanent magnet, and stop members formed by spacer sleeves located between vertical pivot pin supporting strips stop each permanent magnet from being moved into a position where the magnetic axis thereof reaches a position aligned with the magnetic axis of the associated electromagnet core leg.

28 Claims, 19 Drawing Figures

MAGNETICALLY OPERATED SIGN

BACKGROUND OF INVENTION

The present invention relates to signs, and particularly to outdoor signs of the type which generally indicate in digital form time and temperature. Heretofore, such signs have commonly comprised banks of lamps which are selectively energized to display altenately time and/or temperature information.

Lamp bank signs require a substantial amount of electrical energy to operate because they must be continuously electrically energized, and to reduce the amount of electrical energy necessary to operate such signs it has been proposed to replace the banks of indicating lamps with pivotally mounted discs brightly colored on one side and generally black on the opposite side. For daytime use, the brightly colored side is readily visible under ambient light conditions. For nighttime use, a light source is directed upon the front face of the sign to brightly illuminate the brightly colored sides of the indicating discs facing forwardly. Each indicating disc is attached to a permanent magnet mounted for rotation upon an axis lying in a plane parallel to the viewing plane of the sign involved. In one form of such sign described in U.S. Pat. No. 3,518,664, the permanent magnets are bar magnets each of which extends between a pair of the vertically spaced electromagnet core legs extending transversely of a vertical support panel. When an electromagnet is momentarily energized with a current of a given desired polarity, an opposing magnetic field is generated which generally causes the adjacent bar magnet to move into an opposite position provided the electromagnet produces a net turning torgue. Although usually slight unsymmetrical weight distributions ensures that a net turning torgue is generally produced, such is not always the case.

In the magnetically operated flip disc sign of U.S. Pat. No. 3,518,664, indicating disc stops are provided for limiting the angle of rotation of bar magnets and associated indicating discs to less than 180°, which would normally prevent the magnetic axes of the bar magnets from being aligned with the core legs so as to assure the development of a net turning torgue on the permanent magnets when the associated electromagnets are energized. However, due to the presence of biasing magnets, the magnetic axes to which the bar magnets tend to become aligned upon energization of the associated electromagnets are inclined to a line between the ends of the associated pairs of core legs, and the bar magnets become oriented in perfect alignment with such magnetic axes. However, the energization of an electromagnet produces a resultant magnetic field which is misaligned with the bar magnet field in a direction to rotate the same way from its associated stop.

The various magnetically operated flip disc signs heretofore proposed left much to be desired from the standpoint of their reliability, space occupied thereby, and the cost of constructing and operating the same. A common objective of the designers of such signs is to minimize the amount of electrical power necessary to flip each permanent magnet when an electromagnet is energized momentarily.

It is thus an object of the invention to provide a magnetically operated sign having banks of permanent magnet-carrying indicating discs or the like as above described where the amount of electrical energy needed to flip an indicating disc from one position to another is minimized.

Another object of the invention is to provide a magnetically operated sign comprising permanent magnet-carried indicating discs or the like wherein the sign can be reliably constructed at less cost than the magnetically operated flip disc sign heretofore constructed.

Still another object of the invention is to provide a magnetically operated sign similar in some respects to that shown in U.S. Pat. No. 3,036,300, where the electromagnet which operates each permanent magnet has only a single core leg extending horizontally from a support panel, with the permanent magnet confronting the front face of such core, so that the electromagnet can be of a very simple and compact construction, and further wherein the sign operates more reliably and preferably with the more efficient use of electrical energy. A further object of the present invention is to provide a magnetically operated flip disc sign where the different parts thereof are constructed so that they can be more easily assembled and dis-assembled for servicing or relocation than prior magnetically operated flip disc signs.

SUMMARY OF THE INVENTION

In a preferred form of the present invention, as in the case in some forms of prior magnetically operated flip disc signs, each permanent magnet is mounted for rotation about a horizontal axis parallel to the viewing plane of the disc and limited in its rotational movement to less than 180° to insure the presence of a starting torgue when the associated electromagnet is momentarily energized in either one of its stable positions. Also, the electromagnet comprises a single core leg extending transversely forwardly from a support frame so that the forwardly facing end face of the core leg is positioned rearwardly of the associated permanent magnet, as shown in said U.S. Patent No. 3,036,300. However, unlike the relationship of the permanent magnet and electromagnet core shown in the latter patent, in accordance with one of the features of the present invention the axis of rotation of the permanent magnet is offset upwardly from the center line and the magnetic axis of the associated electromagnet core. Also, the shape of the permanent magnet is preferably such that in one of the two opposite stable positions of the permanent magnet its magnetic axis will be parallel to the axial center line of the associated core leg (but displaced upwardly with respect thereto).

A stop member is provided for limiting the movement of the permanent magnet beyond this point when it is flipped into the latter position. Because the axis of rotation of the permanent magnet is spaced upwardly of the center line of the electromagnet core, the magnetic force applied thereto by the electromagnet core will have a component in the opposite direction from gravity so as to reduce the force necessary to overcome the frictional forces opposing rotation thereof. The stop member is also designed to limit the movement of the permanent magnet flipped from the position where its magnetic axis is parallel to the center line of the associated electromagnet core leg to a degree where it will be stopped short of the point where it will reach a stable position. In other words, the magnetic axis of the permanent magnet will be stopped at a position angled toward the associated electromagnet core leg, so that when the electromagnet is again momentarily energized in an opposite sense from its previous energization a magnetic force is generated which rotates the permanent magnet in the opposite direction. While the latter force has a component operating in the direction of gravity, for reasons to be explained, gravity actually reduces the turning torgue necessary to flip the permanent magnet, so that the fact that the magnetic force has a gravity-directed component does not actually oppose the turning movement of the permanent magnet as would be expected.

In accordance with another feature of the present invention, the permanent magnets, which are preferably annular or ring-shaped members having bearing sleeves which rotatably support the same on pivot pins, are each most preferably provided with a slot in the end face thereof which receives an extension of an indicating disc. The pivot pin preferably also passes through a pivot pin-receiving recess formed in the indicating disc so that the indicating disc is maintained in centered relationship with the center of the annular permanent magnet and the pivot pin. A curved strap may be provided on the indicating disc which, together with the defining walls of the pivot pin-receiving recess in the disc, forms a cylindrical bearing about the pivot pin.

In accordance with a still further feature of the invention, the indicating discs are preferably arranged in vertically spaced horizontal rows, and a single horizontal pivot pin pivotally supports a number of permanent magnets and associated indicating discs. Each such pivot pin extends between horizontally spaced vertical supporting strips maintained in rigid spaced relationship by spacer sleeves which form the added function of acting as the aforesaid stop members which limit movement of the indicating discs to an angle less than 180° for reasons previously explained.

In accordance with a further feature of the invention, the magnetically operated sign when used to form a time and/or temperature sign comprises individual digit character indicating assemblies each including the electromagnets, permanent magnets, and indicating discs previously described which are to form a single numeric digit and/or a colon. Each indicating assembly is preferably separately supportable within the frame of the sign on a means preferably including a horizontal upwardly extending lip formed at the upper margin of the frame of the sign. In such case, each indicating assembly preferably has a hook-shaped upper margin which hooks over the lip of the frame and is preferably anchored in place by a screw or the like at the bottom portion of each indicating assembly.

The above and other objects, advantages and features of the invention will become apparent upon making reference to the specification to follow, the claims and the drawings.

EXEMPLARY EMBODIMENT OF THE INVENTION

Figure 1:
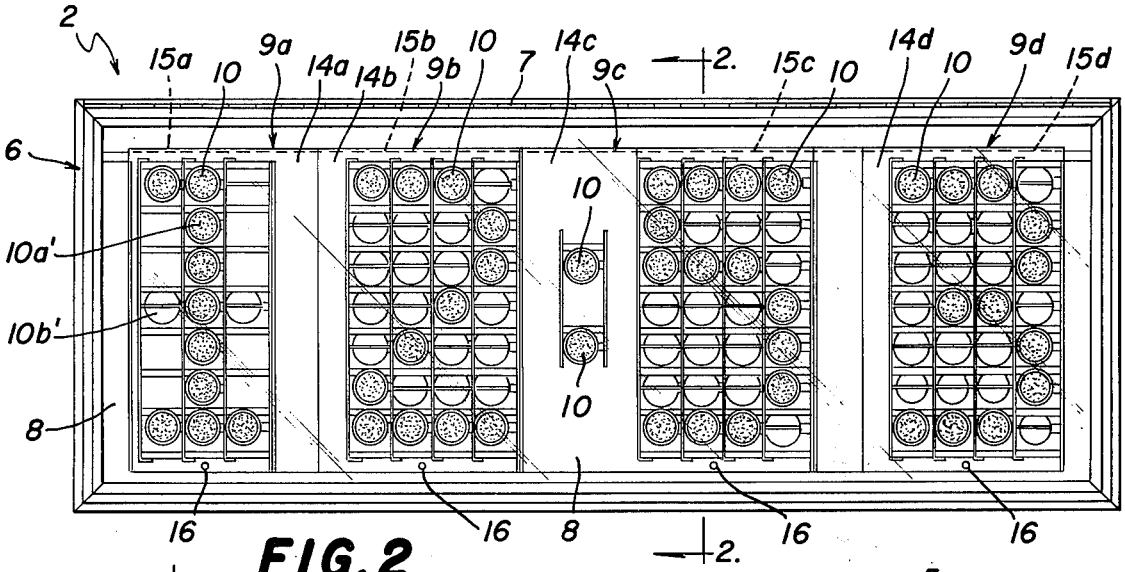
FIG. 1 is a front elevational view of a time and temperature sign constructed in accordance with the present invention.
Figure 2:
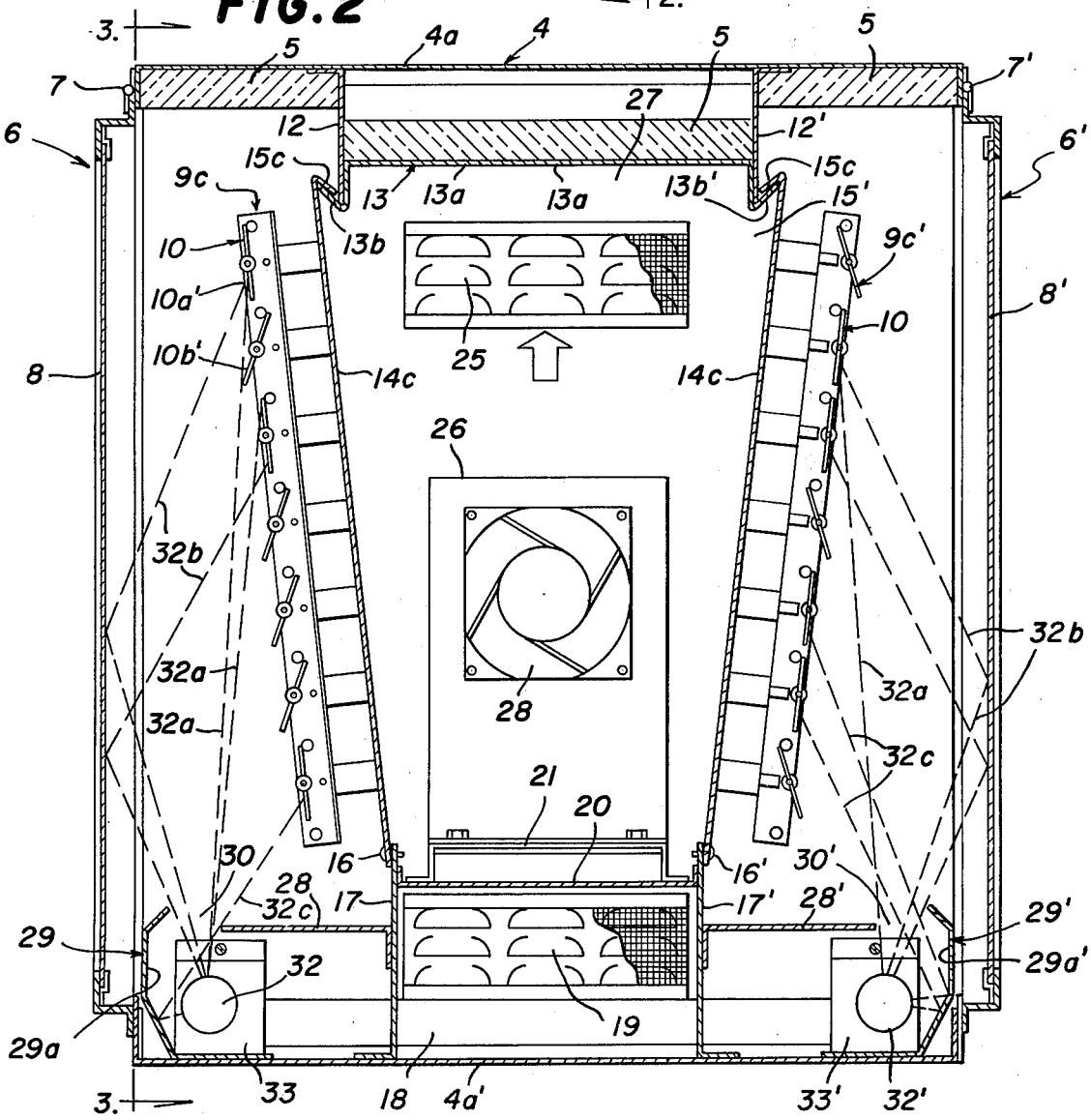
FIG. 2 is an enlarged transverse vertical sectional view through the sign of FIG. 1, taken along section line 2—2.
Figure 3:
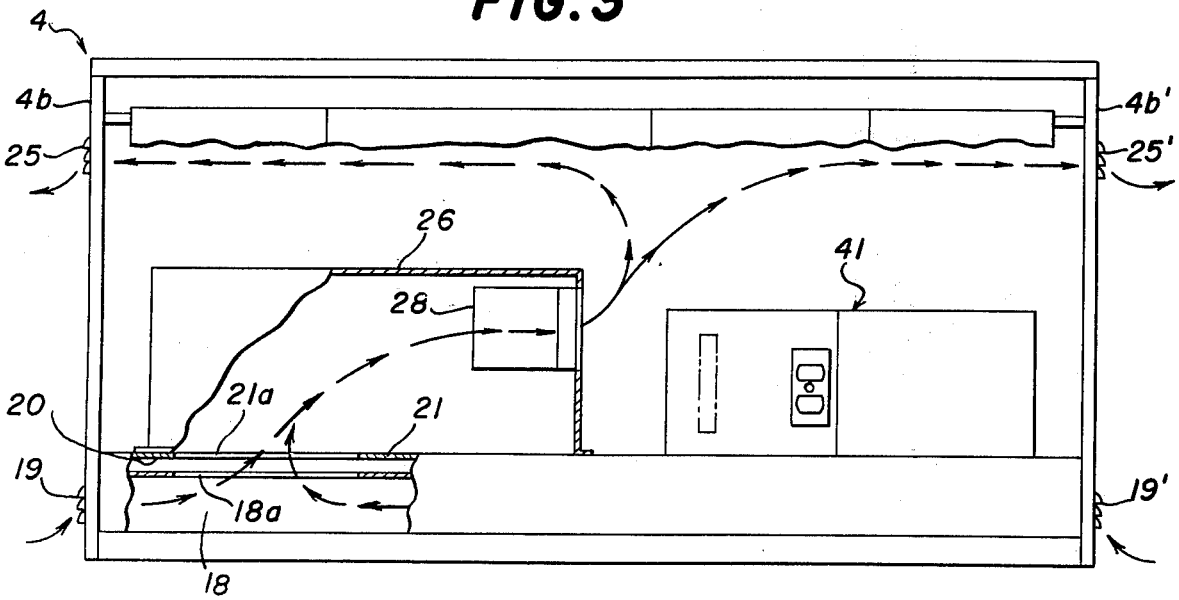
FIG. 3 is a view of the time and temperature sign as seen along a viewing plane 3—3 shown in FIG. 2, and with parts thereof broken or shown in partial section so as to illustrate the flow of cooling air through the sign.
Figure 6:
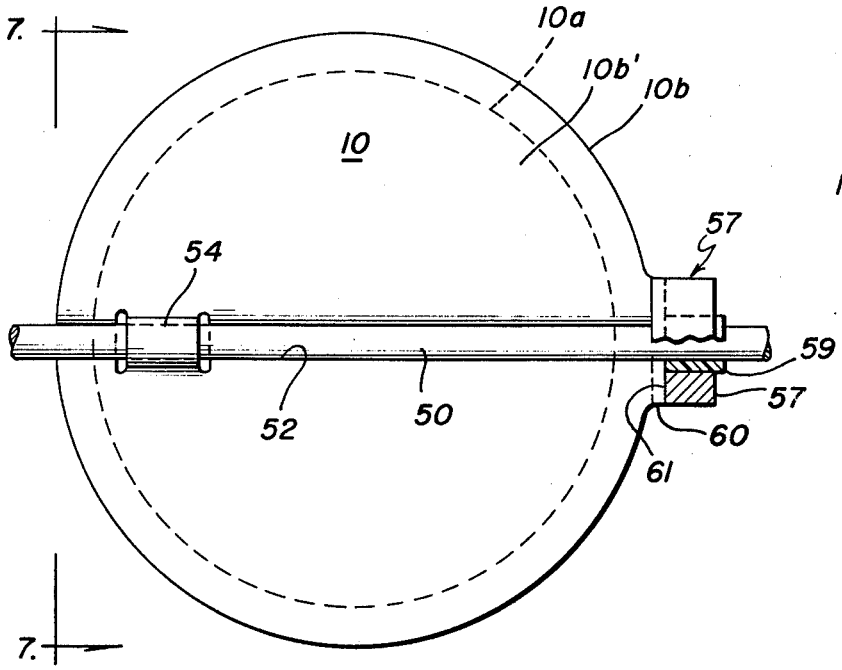
FIG. 6 shows the assembly of an indicating disc, permanent magnet and pivot pin, the permanent magnet being shown in partial-section.
Figure 7:
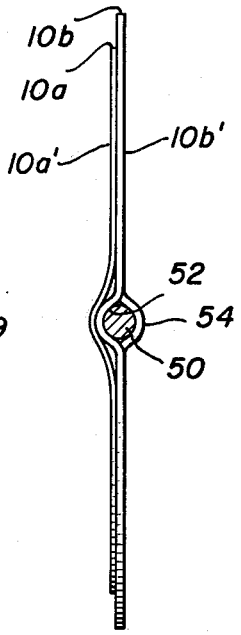
FIG. 7 is a sectional view through FIG. 6, taken along sections line 7—7 thereof.
Figure 9:
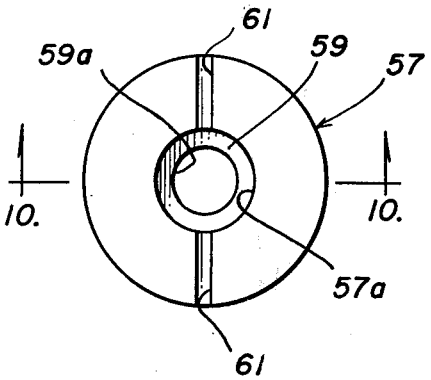
FIG. 9 is end elevational view of a permanent magnet separated from the assembly shown in FIG. 16.

Referring now more particularly to FIGS. 1, 2 and 3, the time and temperature sign there shown and generally indicated by reference numeral 2 includes a main outer housing 4 having top and bottom walls **4*a* and 4*a*′ and end walls 4*b*–4*b*′ which define oppositely facing sign-viewing openings shielded from the elements by doors 6–6′ preferably hinged at the top thereof by piano-type hinges 7–7′. The doors 6–6′ have large windows 8–8′** preferably made of a suitable transparent synthetic plastic material which while transmitting most of the light transmitted therethrough from the interior of the housing have reflective qualities for reflecting a small but significant percentage of the light for reasons to be explained.

Visible through each of the windows 8–8' are digit indicating units 9a, 9b, 9c and 9d. These digit indicating units are constructed and mounted in a unique manner to be described. Each digit indicating unit includes a number of flippable indicating discs 10 aligned horizontally and vertically in rows and columns, each disc having a relatively dark or non-light reflecting face 10b' and an opposite highly light reflecting face 10a'. The indicating discs are flippable by magnetic means to be described which are momentarily energized to reflect flipping of the disc to one position or the other where either the face 10a' or 10b' is visible through the adjacent window 8 or 8'. The lefthand most digit indicating unit 9a opposite each of the windows 8 and 8' comprises only three columns of seven indicating discs 10 which can form the digit "1" or a negative sign "—". The next digit indicating unit 9b is shown comprising four columns of seven indicating discs 10 which can form any of the digits 0-9. The next digit indicating unit 9c is shown as including a pair of vertically spaced indicating discs 10-10 to form a colon sign ":" and four columns of seven indicating discs 10 which can form any of the digits 0-9. The right-hand most digit indicating unit 9d is shown as including four columns of seven indicating discs which can form any of the digits 0-9.

Each of the digit indicating units 9a, 9b, 9c and 9d is suspended within the housing 4 on a framework which includes laterally spaced vertical walls 12–12' anchored to the upper wall 4a and interconnected by a horizontally extending sheet metal panel 13 having a main center portion 13a terminating at the opposite longitudinal margins thereof in hook-shaped upwardly and outwardly extending lips 13b–13b'. Insulating batts 5 are shown below the upper housing wall 4a. Each digit indicating unit includes a main support panel 14a, 14b, 14c or 14d, preferably made of a material which has a low magnetic reluctance, such as mild steel sheet. Each sheet metal panel 14a, 14b, 14c or 14d has formed at the upper margin thereof a downwardly and rearwardly inclined lip 15a, 15b, 15c or 15d which hooks over the aforementioned upwardly and outwardly inclining lip 13b or 13b' of the housing frame to be suspended therefrom. Each of the digit indicating units are then preferably anchored so that its support panel inclines downwardly and inwardly, as best illustrated in FIG. 2, by a screw 16 threaded into an aperture in a longitudinally extending vertical wall 17 or 17' mounted in a suitable way to the bottom wall 4a' of the housing 4. The support panels 14a, 14b, 14c and 14d are positioned in or opposite what are sometimes referred to as accommodation openings defined between the upwardly and outwardly inclining lips 13b–13b', at the upper section of the housing 4 and vertical walls 17–17' at the bottom of the housing.

The longitudinal walls 17–17' are shown interconnected by a channel-shaped support member 20 anchored to the walls 17–17' to define both a support base and an air conduit-forming space 18 extending the length of the housing 4. The housing end walls 4b–4b' having adjacent the bottom margin thereof louver-forming openings 19–19' through which is drawn cooling air which passes through the space 18, an aperture 18a (FIG. 3) and apertures 21a in a wall 21 into enclosure 26 in which is mounted a fan 28. The operation of the fan 28 causes a suction which draws the air through the louver-forming openings 19–19' and into the space 18 and enclosure 26 and then into a space 27 defined between the indicating unit panels 14a, 14b, 14c and 14d. The circulated air exits the housing 4 from louver-forming openings 25–25' formed in the upper portions of the housing end walls 4b–4b'.

Extending outwardly from the vertical walls 17–17' are horizontal baffle-forming walls 28–28' which terminate in spaced relationship to the light reflecting surfaces 29a–29a' of light reflectors 29–29' respectively located near and secured to bottom wall 4a' adjacent to the windows 8–8'. Flourescent tubes 32–32' mounted in socket-carrying supports 33–33' direct light rays 32a–32b which pass directly through openings 30–30' defined between the light reflectors 29–29' and baffle forming walls 17–17' and light rays 32c which reflect off the light reflectors 29–29'. Light rays 32a passing directly through the openings 30–30' directly strike only the upper indicating discs 10 and other light rays 32b passing directly through the openings 30–30' are reflected off of the partially light reflecting windows 8–8' at angles which illuminate only the upper indicating discs which are more remote from the flourescent tubes 32–32' and, therefore, would otherwise have a lesser degree of light otherwise reflected therefrom. Light rays 32c which reflects off the light reflectors 29–29' are directed only against the indicating discs in the lower section of the digit indicating units.

Reference should now be made to FIGS. 4–13 which illustrates the unique details of construction of a preferred exemplary digit indicating unit 9b, it being understood that the manner in which the indicating discs thereof are constructed, mounted and operable, apply equally to the other digit indicating units 9a, 9c and 9d.

Mounted on the outer or front face of the support panel 14b of light indicating units 9b are electromagnets 40 which are arranged in vertically spaced horizontal rows with the corresponding magnets in each row aligned vertically. Each electromagnet includes a main body portion 40a which includes the base portion of a mild steel core 44 extending transversably outwardly from the inclined and generally upwardly extending support panel 14b. Each core 44 is made of mild steel and wound with coils of wire to form an electromagnet. Each electromagnet is anchored in place on the panel 14b by a screw 42 extending through the panel 14b and threading into the base of the core 44. The coils of each electromagnet 40 are connected to suitable electrical control equipment generally indicated by reference numeral 41 in FIG. 3, where such equipment is shown supported on the support member 20 adjacent to the fan 28. The control equipment feeds positive or negative pulsations of current to the coil of a selected electromagnet to effect a north or south polarity of magnetic lines of force at the end of the associated core 44. Each core 44 is shown as having a rectangular cross-section, although other shapes may be used, and preferably a flat end face 44a thereof extending parallel to the support surface of the panel 14b. Anchored to the corresponding flat side faces of each group of cores 44 aligned vertically is a vertical support strip 46 having a vertically extending leg 46b anchored by a screw 48 or 48' to each core in the vertical row of cores involved and a horizontal leg 46a which preferably bears upon a rigid outer wall of each body portion 40a of the electromagnet. The support strips 46 act as supports for stationary cylindrical pivot pins 50 passing through aligned apertures in the various supporting strips aligned along horizontal lines passing above the center lines of the cores.

Figure 13:
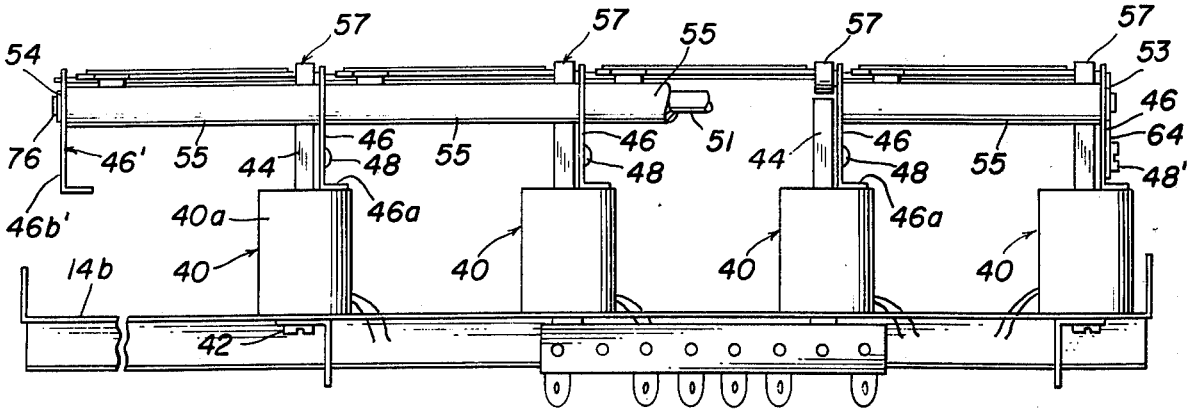
FIG. 13 is an enlarged bottom view of the digit indicating unit of FIG. 11, as seen along viewing plane 13—13 shown therein.

As shown in FIG. 13, the pivot pins 50 extend beyond one of the vertical rows of electromagnets 40 and pass through a strip 46′ which is not supported or anchored to any electromagnet. The strip 46′ and the other strips 46 are formed into a rigid inter-connected framework by spacer sleeves 55 between the strips, the sleeves surrounding the rods 51 passing through aligned apertures in the support strips 46 and 46′ and held against axial movement by snap rings 53 and 54 or the like. The spacer sleeves 55 also serve the additional function of acting as stops for limiting the degree of pivotal movement of the various indicating discs 10 to less than 180°.

Each of the pivot pins 50 rotatably support a number of horizontally aligned indicating discs 10 located between contiguous pairs of horizontally spaced vertical supporting strips 46 and 46′. In the most preferred form of the invention, each indicating disc 10 includes a main body portion which is illustrated as a circular metal disc body 10*b* (FIGS. 6–7) which is preferably black on the aforementioned non-light reflecting face 10*b*′ of the indicating disc. Each disc body 10*b* has a semicircular depression or deformation extending diametrically thereacross. A strap 54 is punched from the indicating disc body 10*b* so as to form a semicylindrical extension thereof, the inner surface of which falls along the same cylindrical as the defining walls of the inner surface of the semicylindrical recess 52. The inner surface of each strap 54 and associated recess 52 thus forms curve surfaces which slidably engage and pivot upon the cylindrical outer surface of the pivot pin 50 associated therewith.

The light reflecting face 10*a*′ of each indicating disc 10 may be formed in any suitable way, but is preferably formed by a sheet of high light reflecting plastic material secured by an adhesive to the side of the indicating disc body 10*b* opposite from the face 10*b*′ thereof.

Each indicating disc body 10*b* has a neck portion 60 (FIG. 6) which projects into a slot 61 formed in one of the end faces of an annular permanent magnet 57. Each annular permanent magnet 57 preferably is made of a permanently magnetizable material, such as Alnico, and has a bearing-forming sleeve 59 adhesively or otherwise anchored within a central circular aperture 57*a* of the permanent magnet 57. The sleeve 59 has a circular aperture 59*a* thereof which is slidably supported around a pivot pin 50 which extends therethrough.

Figure 10:
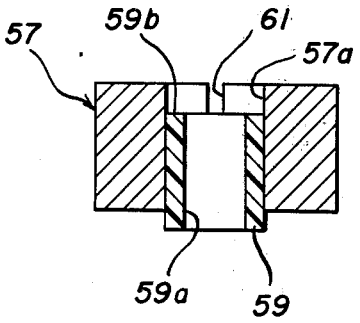
FIG. 10 is a sectional view through the permanent magnet shown in FIG. 9, taken along section line 10—10 thereof.
Figure 11:
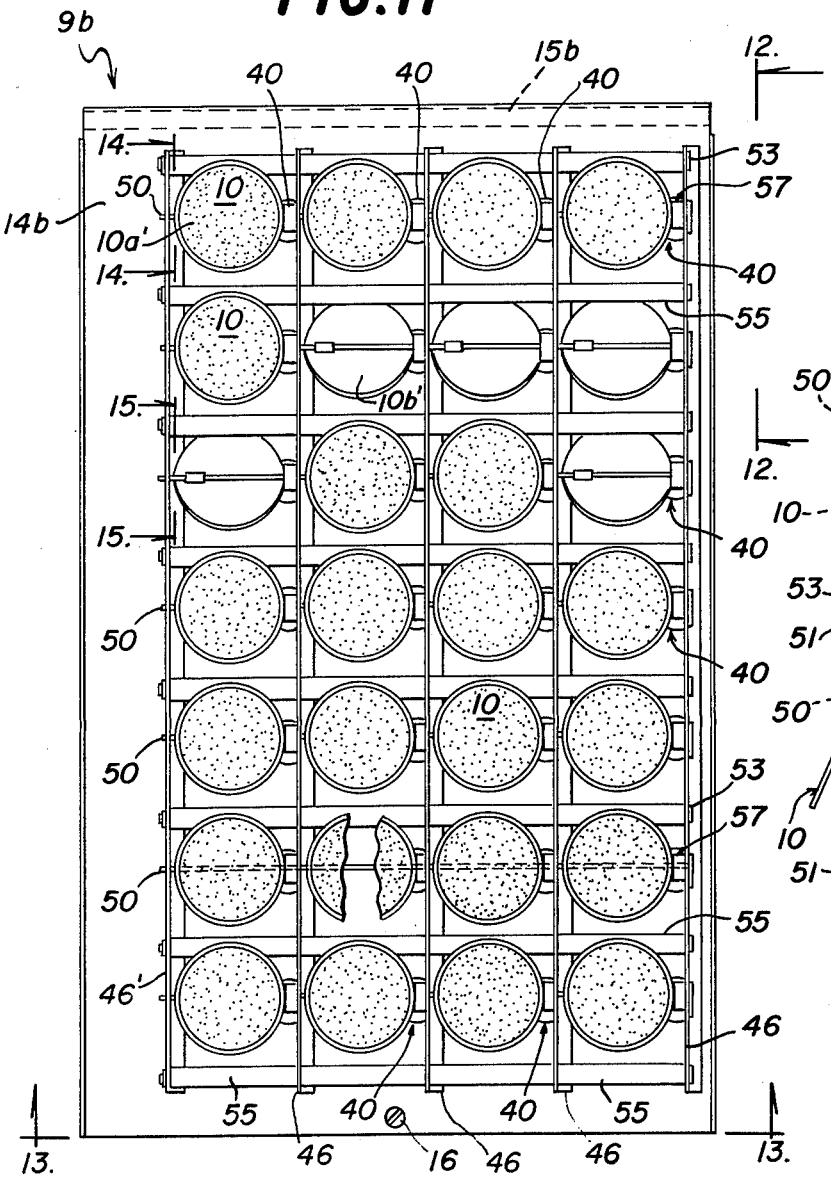
FIG. 11 is a greatly enlarged view partly broken away of one of the digit indicating units forming part of the sign shown in FIG. 1.
Figure 12:
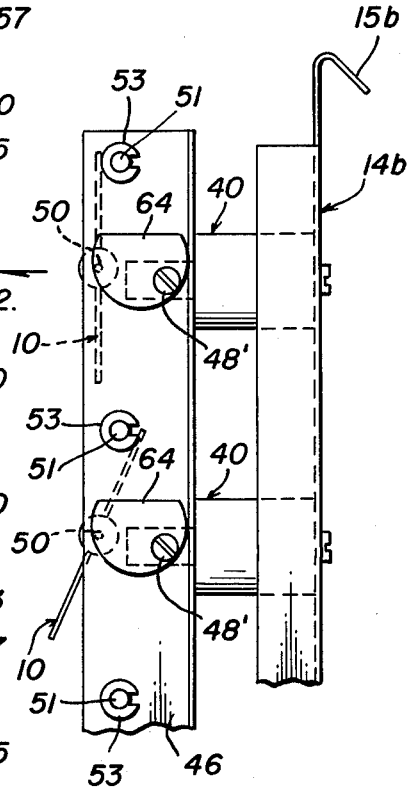
FIG. 12 is an enlarged fragmentary side view of the upper portion of the digit indicating unit FIG. 3, as seen along viewing plane 12—12 therein.

Each sleeve 59 is preferably mounted within an aperture 57*a* of the associated permanent magnet 57 so that one end face thereof is recessed within the permanent magnet as best shown in FIG. 10 to provide an abutment shoulder 59*b* for the projecting neck 60 of the associated indicating disc 10. The opposite end of the sleeve projects beyond the opposite face of the permanent magnet to abut one of the outer faces of the adjacent support strip 46 which acts as an end bearing for the sleeve 59. The sleeve 59 may be made of a suitable friction reducing synthetic plastic material. Similarly, each of the pivot pins 50 may be made of a friction reducing synthetic plastic material.

It should be apparent that as a magnetic force is applied to a permanent magnet 57 tending to rotate in one direction or the other, the associated indicating disc 10 anchored thereto will follow the rotation of the permanent magnet. Each permanent magnet is magnetized so as to provide a magnetic axis 67 shown in FIG. 14–17 which extends at right angles both to the pivot pin 50 passing therethrough and the plane of the associated indicating disc. In the stable positions of the permanent magnet to be described, this magnetic axis thereof will assume a position as shown in FIG. 14 where it is generally parallel to the center line 65 of the associated electromagnet core 44 or a position where it angles downwardly toward the end face 44*a* of the associated core as shown in FIG. 15.

Figure 4:
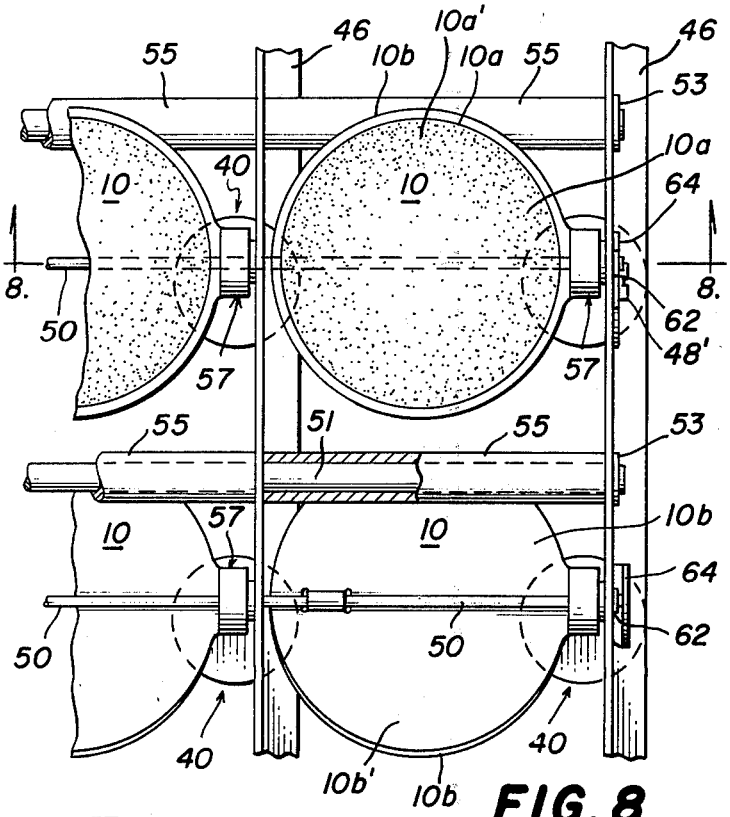
FIG. 4 is a greatly enlarged fragmentary and partly broken away elevational view of four of the indicating discs forming part of the digit indicating unit of FIG. 3.
Figure 5:
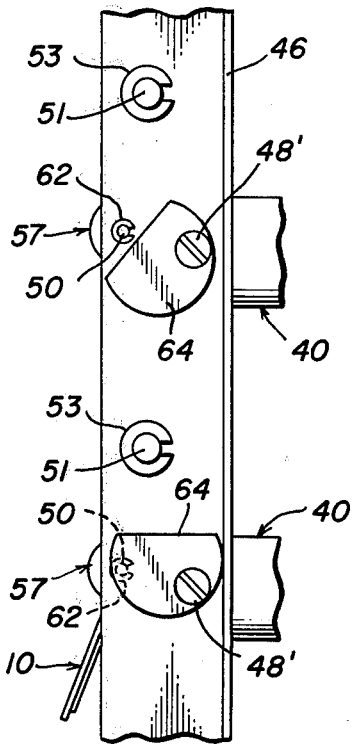
FIG. 5 is a side elevational view of the portion of the digit indicating unit shown in FIG. 6, and illustrates one of the pivot shaft retaining plates loosened and pivoted into a position permitting the removal of a pivot pin from the frame of the digit indicating unit involved.
Figure 8:
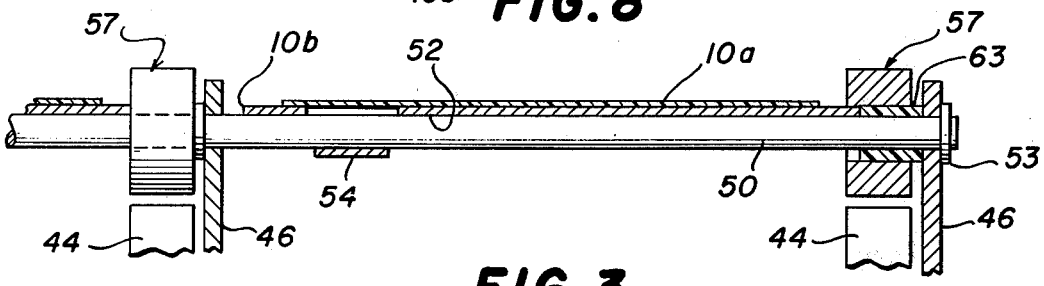
FIG. 8 is a transverse sectional view through the assembly shown in FIG. 4, taken along section line 8—8 thereof.

The various pivot pins 50 are anchored in place within the supporting strips 46 by means preferably including a snap ring 62 which prevents movement of each pivot pin to the left as viewed, for example, in FIG. 4, and a holding plate 64 which normally is positioned opposite the right hand end of each pivot pin to prevent the pivot pin from moving to the right. A pivot pin can be removed so that the associated indicating disc can be replaced or serviced by moving the holding plate 64 away from the end of the associated pivot pin. To this end, each holding plate 64 is preferably anchored in place by a screw 48′ which anchors the outermost support strip 46 to the adjacent core 44. By slightly loosening a screw 48′, a holding plate 64 can be rotated out of the way, exposing the end of the associated pivot pin 50, as shown in FIG. 5.

The most effective use of the electrical energy pulsations used to energize a selected electromagnet depends greatly upon the proper selection of the materials out of which the various parts of the digit indicating units are made. Thus, the fact that the electromagnets are mounted on a support panel made of a metal which has a relatively low magnetic reluctance is of considerable importance to this end. It is also important that most if not all of the other portions of the digit indicating units, except the electromagnet cores 44, be made of a nonmagnetic material, such as aluminum or a synthetic plastic material which has a high magnetic reluctance.

Figure 14:
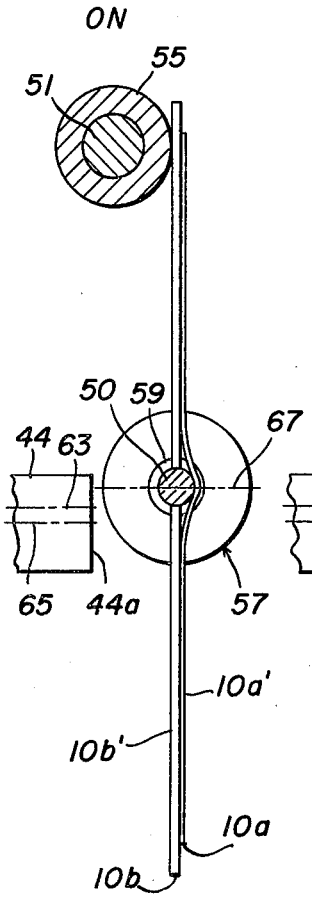
FIGS. 14 and 15 are greatly enlarged vertical sectional views taken through the pivot pin of one of the indicating discs in the digit indicating unit of FIG. 4 when the indicating disc is respectively in a relatively visible and a non-visible position, the figures also showing an indicating disc and attached permanent magnet, electromagnet core leg and stop member associated with the indicating disc to control the limits of movement thereof and the attached permanent magnet.
Figure 15:
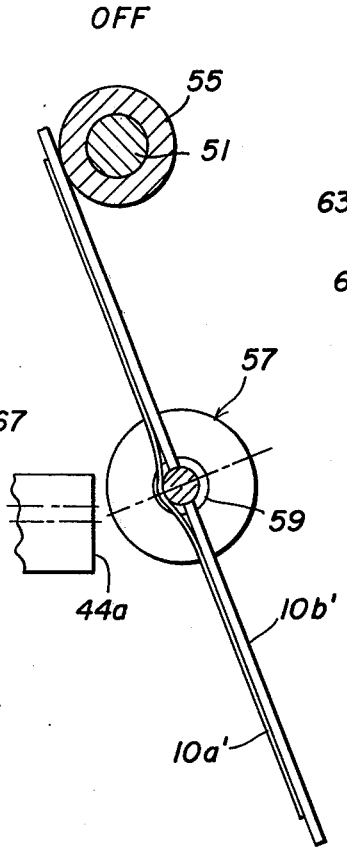
Figure 16:
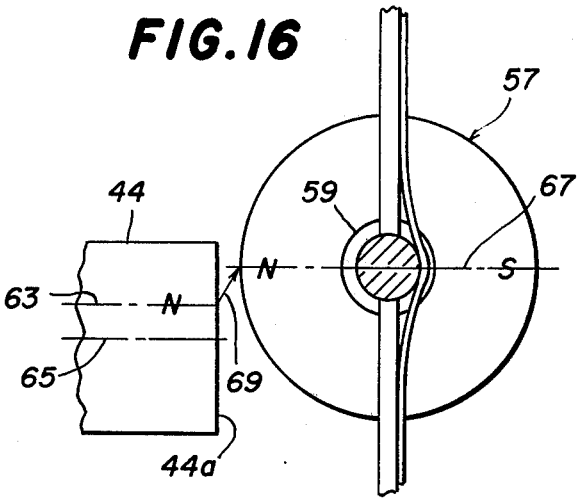
FIGS. 16 and 17 are views corresponding to FIGS. 14 and 15, and showing in enlarged form the permanent magnet with its magnetic axis and polarity indicated thereon and the associated core leg with its magnetic axis and polarity indicated thereon when the electromagnet is momentarily energized to effect the flipping of the permanent magnet and associated indicating disc into an opposite position from that illustrated.

For a better understanding as to how the various discs 10 are flipped from one extreme position to the other, reference should now be made to FIGS. 14–19. FIGS. 14 and 16 show the position of an indicating disc 10 when the light reflecting face 10*a*′ thereof faces in the direction of the adjacent window 8 or 8′ of the sign housing 4. As illustrated, the plane of the indicating disc is then preferably parallel to the associated support panel of the digit indicating unit involved, and the magnetic axis 67 of the associated annular permanent magnet 57 is parallel to the central axis 65 of the associated electromagnet core 44 when the core is substantially unmagnetized. The magnetic axis of the permanent magnet moves toward a position where it will be opposite the closest point of the core end face. It is believed that the positioning of the annular permanent magnet 57 so its axis of rotation is offset upwardly of the center line of the core 44 may raise the magnetic axis 63 of the core when it is energized, but such axis should remain below the magnetic axis 67 of the permanent magnet 57. The adjacent sleeve 55 acts as a stop on the indicating disc 50 just before it reaches a perfectly stable position and prevents further counterclockwise rotation thereof to eliminate or reduce hunting and vibrations. There is provided some looseness in fit between the pivot pin 50 and the permanent magnet sleeve 57 so that at all times before the electromagnet involved is energized, the attraction of the permanent magnet to the core 44 directed toward the core will cause the point of contact between the sleeve 59 and the pivot pin 50 to be at point P1 on the side of the sleeve facing away from the core.

Figure 17:
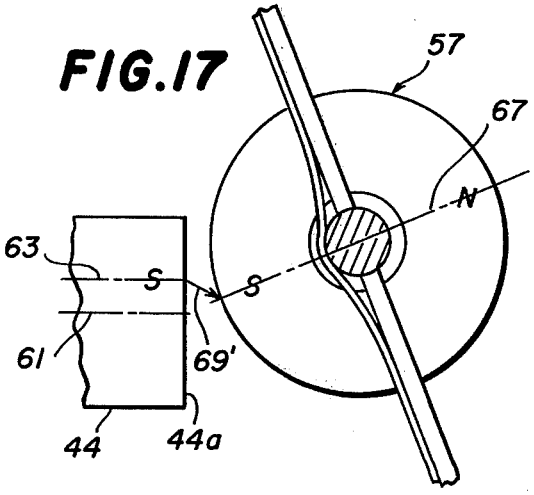
Figure 18:
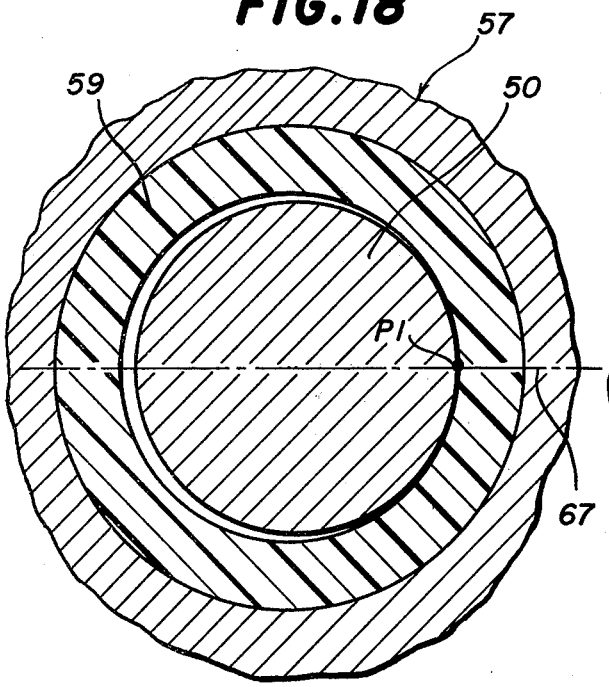
FIG. 18 shows a still further enlarged fragmentary sectional view of a pivot pin and a permanent magnet positioned as shown in FIG. 10 prior to the energization of the adjacent core leg to effect rotation thereof into an opposite position.
Figure 19:
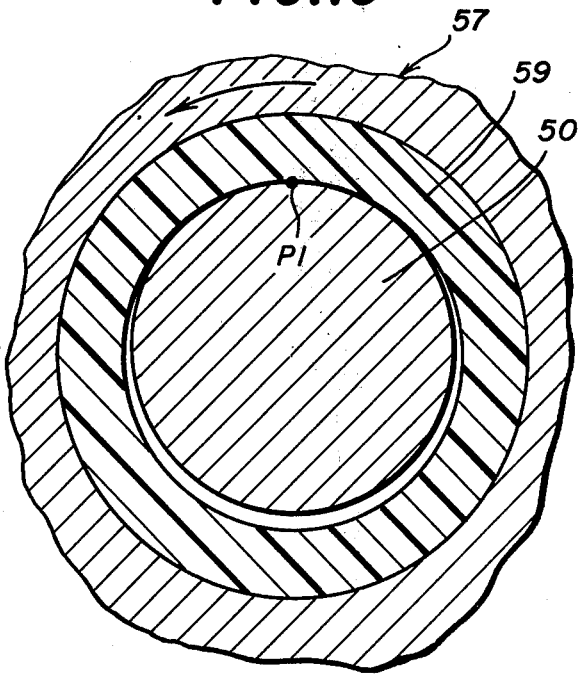
FIG. 19 is a view corresponding to FIG. 18 after the electromagnet has been energized to effect the counterclockwise rotation of the permanent magnet illustrated.

When the core 44 is momentarily energized, it will be seen from FIG. 16 that the magnetic flux generated by the core leg, which is assumed for purposes of explanation to be concentrated or at least centered or maximized along the magnetic axis line 63, will be directed in an upwardly and outward direction as shown by the arrow 69, so that a clockwise rotation is imparted to the permanent magnet 57 as viewed in FIG. 16. This upwardly directed magnetic force thus operates in a direction in opposition to gravity, thereby reducing the frictional force tending to oppose movement of the permanent magnet. As the indicating disc 10 flips over, the inertia of the flipping action will cause the disc to move into a position where the south pole thereof will be drawn to the end face 44*a* of the core. The indicating disc, however, will strike the left hand side of the stop sleeve 55, as shown in FIG. 15, before the magnetic axis 67 of the permanent magnet can reach a position where it is even closely parallel to the magnetic axis 63 of the core 44. As shown in FIG. 17, the indicating disc is brought to a stop at a point where the permanent magnet axis 67 makes a substantial angle to the magnetic axis 63 of the core and where the axis 67 is directed below the magnetic axis 63 of the core. Thus, upon subsequent energization of the core to produce a south pole at the end face 44*a* thereof, the resultant magnetic forces centered or maximized along the magnetic axis line 63 will impart a downwardly and outwardly inclined force on the permanent magnet to cause the permanent magnet 57 to rotate in a counterclockwise direction.

Before the core 44 is again energized to form a south pole as shown in FIG. 17, as previously indicated, the attractive force between the permanent magnet 57 and the closest point of the end face of the core 44 will be in a direction where the point of contact between the inner surface 59*a* of the sleeve 59 and the pivot pin 50 is at a point P1 on the side of the sleeve remote from the core. However, because of the point contact condition just described, while a downwardly and outwardly directed magnetic force on the permanent magnet occurring when the core 44 is energized in a direction to produce a south pole as shown in FIG. 17 operates in a direction which would seem to reinforce gravity apparently to increase the frictional forces on the sleeve 59 tending to hinder its rotation, nevertheless this downward force operates to overcome this increased force, because the sleeve 59 cannot drop to move the point of contact between the sleeve and the pivot pin without rolling in a counterclockwise direction over the pivot pin 50, as illustrated in FIG. 5. Thus, the downwardly directed magnetic force on the permanent magnet actually aids in imparting a counterclockwise rotation thereto.

It should be understood that numerous modifications may be made in the most preferred form of the invention described without deviating from the broader aspects of the invention. Thus, while the positioning of the core and permanent magnet of each permanent magnet confronting only the end face of a single core leg which extends transversely from the support panel of the digit indicating unit involved is far preferred to other arrangements, as, for example, where the permanent magnet is supported between horizontally or vertically spaced confronting pole faces, because of the reduced costs and space requirements, some of the features of the invention have applicability and are useful even when such inferior relationships between the permanent magnets and the cores exist.

I claim:

1. A magnetically operated sign comprising: a panel made of a material of low magnetic reluctance, and a plurality of magnetically operated indicating devices carried by the panel, each indicating device comprising a reversibly energizable electromagnet having a core with only a single leg projecting from said panel and a coil around said leg for producing at the end of said core leg when said winding is energized a magnetic field which is of one polarity or the other depending upon the direction of energization of the coil, a permanent magnet confronting each core and having a magnetic axis extending between opposite magnetic poles, means for rotatably mounting said permanent magnet for rotation in a plane transverse to said panel about an axis of rotation which is between the poles thereof and parallel to said panel, the coil of the electromagnet upon momentary energization thereof in one direction or the other causing the magnetic field produced at said one end of the core leg to react with the magnetic field of the permanent magnet to rotate the permanent magnet about said axis of rotation to a position where one pole or the other thereof confronts the end of the associated core leg, and an indicating element having contrasting appearing surfaces on opposite sides thereof secured to each permanent magnet and rotatably mounted for rotation with said permanent magnet about said axis of rotation, to present one or the other of said contrasting surfaces to view, depending upon which pole of said permanent magnet confronts the associated core.

2. The sign as defined in claim 1 including a plurality of spaced apart parallel supporting strips of non-magnetic material anchored to said panel and located adjacent to said permanent magnets, a plurality of pivot pins of non-magnetic material extending perpendicularly to and secured to said supporting strips and forming the axes of rotation for the permanent magnets and indicating elements, each of said permanent magnets being an annular member through the center of which one of said pivot pins passes and supports the same for pivotal movement.

3. In a magnetically operated indicating sign including a generally vertically oriented panel and a plurality of magnetically operated indicating devices, each indicating device comprising a reversibly energizable electromagnet having a generally horizontally extending core and an electric coil for producing at one end of the core when the electric coil is energized a magnetic field which is of one polarity or of opposite polarity depending upon the direction of energization of the electric coil, a permanent magnet having a magnetic axis and opposed poles of opposite polarity for producing respectively thereat magnetic fields of corresponding opposed polarity, means for rotatably mounting said permanent magnet adjacent to and in alignment with said one end of said core of the electromagnet about a generally horizontal axis of rotation which is between the poles generally parallel to said panel and perpendicular to the magnetic axis of the permanent magnet and which is perpendicular to the centerline of said one end of the core, the electric coil of the electromagnet upon energization thereof in one direction or the other causing the magnetic fields produced at said one end of the core thereof to react with the magnetic fields of the permanent magnet to rotate the permanent magnet about the axis of rotation between substantially opposite angular positions with the magnetic axis of the permanent magnet substantially parallel to the centerline of said one end of the core of the electromagnet, an indicating element having contrasting appearing surfaces on opposite sides thereof secured to said permanent magnet and rotatably mounted for rotation with said permanent magnet about said axis of rotation between said substantially opposite angular positions to present one or the other of said contrasting surfaces to view, the improvement wherein each said permanent magnet and associated indicating element is located forwardly of said panel and confronts the outer end of said core, said axis of rotation of each permanent magnet and indicating element being parallel to said panel and offset upwardly from the axial centerline of said core, the shape of the forward end of said core and the magnetic pole containing ends of said permanent magnet being such as to bring the magnetic axis of said permanent magnet parallel to the axial center line of said core, and stop means for limiting rotation of the permanent magnet about its axis of rotation substantially short of one of said opposite angular positions thereof where the magnetic axis thereof is inclined to the axial center line of the core while permitting said permanent magnet to reach the other angular position where said magnetic axis is parallel to said axial centerline of the core, said upward offset of and said axis of rotation of the permanent magnet providing an upwardly directed force thereon when the coil of the electromagnet is energized to rotate the permanent magnet and the indicating element to its opposite angular position.

4. The indicating sign as defined in claim 3 wherein the core of each electromagnet is a linear core, and includes means for securing the other end of each core to the panel.

5. The indicating sign as defined in claim 4 wherein the panel comprises a ferrous metal to assist in the completion of the magnetic fields of the cores of each electromagnet.

6. The indicating sign as defined in claim 3 including a plurality of spaced apart elongated supporting strips extending perpendicularly to the axes of rotation of the permanent magnets and indicating elements and located adjacent to each permanent magnet, a plurality of pivot pins extending perpendicularly to the elongated supporting strips and secured thereto and forming the axes of rotation for the permanent magnets and indicating elements, and means for rotatably mounting the permanent magnets and indicating elements on said pivot pins.

7. The indicating sign as defined in claim 6 including means for securing the spaced apart elongated supporting strips to the cores of the electromagnets.

8. In a magnetically operated sign including a plurality of magnetically operated indicating devices, each indicating device comprising a reversibly energizable electromagnet having a core and an electric coil for producing at the end of said core when the electric coil is energized a magnetic field which is of one polarity or the other depending upon the direction of energization of the electric coil, a permanent magnet confronting each core and having a magnetic axis extending between opposite magnetic poles, means for rotatably mounting said permanent magnet about an axis of rotation which is between the poles thereof, the electric coil of the electromagnet upon momentary energization thereof in one direction or the other causing the magnetic fields produced at said one end of the core thereof to react with the magnetic fields of the permanent magnet to rotate the permanent magnet about said axis of rotation to a position where one pole or the other thereof confronts the end of the associated core, and an indicating element having contrasting appearing surfaces on opposite sides thereof secured to each permanent magnet and mounted for rotation with said permanent magnet about said axis of rotation, to present one or the other of said contrasting surfaces to view, depending upon which pole of said permanent magnet confronts the associated core, the improvement comprising: a plurality of spaced apart elongated supporting strips extending perpendicularly to the axes of rotation of the permanent magnets and indicating elements and located adjacent to each permanent magnet, a plurality of pivot pins extending perpendicularly to the elongated supporting strips and secured thereto and forming the axes of rotation for the permanent magnets and indicating elements, means for rotatably mounting the permanent magnets and indicating elements on said pivot pins, and a plurality of elongated spacers parallel to the pivot pins and laterally spaced therefrom and extending longitudinally between the spaced apart supporting strips for maintaining the spacing therebetween, said elongated spacers also providing stop means for limiting rotation of the permanent magnets and indicating elements about their axes of rotation.

9. In a magnetically operated sign including a plurality of magnetically operated indicating devices, each indicating device comprising a reversibly energizable electromagnet having a core and an electric coil for producing at the end of said core from said panel when the electric coil is energized a magnetic field which is of one polarity or the other depending upon the direction of energization of the electric coil, a permanent magnet confronting each core and having a magnetic axis extending between opposite magnetic poles, means for rotatably mounting said permanent magnet about an axis of rotation which is between the poles thereof, the electric coil of the electromagnet upon momentary energization thereof in one direction or the other causing the magnetic fields produced at said one end of the core thereof to react with the magnetic fields of the permanent magnet to rotate the permanent magnet about said axis of rotation to a position where one pole or the other thereof confronts the end of the associated core, and an indicating element having contrasting appearing surfaces on opposite sides thereof secured to each permanent magnet and rotatably mounted for rotation with said permanent magnet about said axis of rotation, to present one or the other of said contrasting surfaces to view, depending upon which pole of said permanent magnet confronts the associated core, the improvement wherein each said indicating element comprises an indicating disc having said contrasting appearing surfaces on the opposite faces thereof, each permanent magnet has a slot for receiving an edge of the indicating disc in the slot of the permanent magnet receiving the disc.

10. The indicating sign as defined in claim 9 wherein there is provided a pivot pin for rotatably mounting each indicating element, each said indicating element including groove and strap means for receiving a pivot pin for rotatably mounting the indicating element, and each permanent magnet has a hole therethrough for receiving said pivot pin.

11. In a magnetically operated indicating device comprising: a reversibly energizable electromagnet having a core and an electric coil for producing at one end of the core when the electric coil is energized a magnetic field which is of one polarity or of opposite polarity depending upon the direction of energization of the electric coil, a permanent magnet having a magnetic axis extending between opposite poles, means for rotatably mounting said permanent magnet in confronting relation to only said one end of said core of the electromagnet at the axially facing side thereof and about an axis of rotation which is between the poles and perpendicular to the magnetic axis of the permanent magnet and which is perpendicular to the axial centerline of said one end of the core, the electric coil of the electromagnet upon momentary energization thereof in one direction or the other causing the magnetic fields produced at said one end of the core thereto react with the magnetic fields of the permanent magnet to rotate the permanent magnet about the axis of rotation toward substantially opposite angular positions where the magnetic axis of the permanent magnet is substantially parallel to the axial centerline of said one end of the core of the electromagnet, an indicating element having contrasting appearing surfaces on opposite faces thereof and secured to said permanent magnet for rotation therewith about said axis of rotation to present one or the other of said contrasting appearing surfaces to view, the improvement wherein said axis of rotation of the permanent magnet and indicating element is offset from the centerline of said one end of the core of the electromagnet to offset the magnetic axis of the permanent magnet with respect to the centerline of said core, the shape of the forward end of said core and the magnetic pole containing ends of said permanent magnet being such as to tend to bring the magnetic axis of said permanent magnet parallel to the axial centerline of said core, and stop means for limiting rotation of the permanent magnet about its axis of rotation substantially short of one of said opposite angular positions thereof so the magnetic axis thereof is inclined to the axial centerline of the core while permitting said permanent magnet to reach the other angular position where said magnetic axis is parallel to said axial centerline of the core, said offset of and said limiting of rotation torques for the permanent magnet when the coil of the electromagnet is energized in a direction to rotate the permanent magnet and the indicating element in an opposite direction from that it was previously rotated.

12. The magnetically operated indicating device of claim 11 wherein said axis of rotation of said permanent magnet extends generally in a horizontal direction.

13. The magnetically operated indication device of claim 12 wherein said core of the electromagnet has only one leg confronting said permanent magnet, the confrontation being at the rear of said permanent magnet which, in the absence of energization of said electromagnet, is drawn toward said core leg.

14. The magnetically operated indicating device of claim 8 wherein said core leg extends in a generally horizontal direction and said axis of rotation of said permanent magnet is offset upwardly from the centerline of said core leg.

15. The magnetically operated indicating device of claim 9 wherein said permanent magnet is ring-shaped, the magnetic axis thereof extends diametrically of the ring-shaped permanent magnet.

16. The magnetically operated indicating device of claim 15 wherein said core leg has a flat vertical end face.

17. A magnetically operated indicating device comprising a permanent magnet having a magnetic axis extending between opposite magnetic poles, means for rotatably mounting said permanent magnet about an axis of rotation which is transverse to and between the poles, an indicating element having contrasting appearing surfaces on opposite faces thereof and secured to one axial end of said permanent magnet and mounted for rotation with said permanent magnet about said axis of rotation between said substantially opposite angular positions to present one or the other of said constrasting appearing surfaces to view, a reversibly energizable electromagnet having a core and an electric coil for producing at one end of the core when the electric coil is energized a magnetic field which is of one polarity or of opposite polarity depending upon the direction of energization of the electric coil, said core having only one leg confronting said permanent magnet, and stop means for limiting rotation of the permanent magnet about its axis of rotation substantially short of one of said opposite angular positions thereof where the magnetic axis thereof is inclined to the axial centerline of the core while permitting said permanent magnet to reach the other angular position where said magnetic axis is parallel to but offset from said axial centerline of the core, said offset of and said limiting of rotation of the permanent magnet providing an initial rotating torque for the permanent magnet when the coil of the electromagnet is energized in the opposite direction to rotate the permanent magnet and the indicating element in the opposite direction from the direction it was previously rotated.

18. The magnetically operated indicating device of claim 17 wherein said axis of rotation of said permanent magnet extends generally in a horizontal direction.

19. The magnetically operated indicating device of claim 18 wherein said core leg extends in a generally horizontal direction and said axis of rotation of said permanent magnet is offset upwardly from the centerline of said core leg.

20. The magnetically operated indicating device of claim 19 wherein said permanent magnet is ring-shaped, the magnetic axis thereof extends diametrically of the ring-shaped permanent magnet.

21. The magnetically operated indicating device of claim 20 wherein said core leg has a flat vertical end face.

22. In a magnetically operated sign including support means for supporting a plurality of magnetically operated indicating devices carried by the support means to provide groups of aligned indicating devices, each indicating device comprising a reversibly energizable electromagnet having a core and an electric coil for producing at one end of the core when the electric coil is energized a magnetic field which is of one polarity or of opposite polarity depending upon the direction of energization of the electric coil, a permanent magnet having a magnetic axis and poles of opposite polarity for producing respectively thereat magnetic fields of corresponding opposed polarity, means for rotatably mounting said permanent magnet adjacent to and in alignment with said one end of said core of the electromagnet, the electric coil of the electromagnet upon energization thereof in one direction or the other causing the magnetic fields produced at said one end of the core thereof to react with the magnetic fields of the permanent magnet to rotate the permanent magnet between substantially opposite angular position, an indicating element having contrasting appearing surfaces on opposite sides thereof secured to said permanent magnet for rotation therewith, the improvement wherein corresponding indicating elements and associated permanent magnets in the aligned groups of indicating devices are pivotably supported on a common pivot pin, each pivot pin being supported by supporting strips secured to and carried by aligned electromagnets of one of said aligned groups of indicating devices.

23. The sign of claim 22 wherein said supporting strips are secured to the cores of said electromagnets.

24. The sign of claim 22 wherein said support means is a panel of material of low magnetic reluctance and said supporting strips and pivot pins are made of a material having a high magnetic reluctance.

25. The sign of claim 22 wherein there are means interconnecting said supporting strips to form a rigid indicating element and permanent magnet support structure.

26. The sign of claim 25 wherein portions of said interconnecting means act as stops for said indicating elements limiting rotation thereof to less than 180°.

27. The sign of claim 25 wherein said interconnecting means are rods with laterally projecting means at the ends thereof.

28. In a magnetically operated sign including support means for supporting a plurality of magnetically operated indicating devices carried by the support means to provide groups of aligned indicating devices, each indicating device comprising a reversibly energizable electromagnet having a core and an electric coil for producing at one end of the core when the electric coil is energized a magnetic field which is of one polarity or of opposite polarity depending upon the direction of energization of the electric coil, a permanent magnet having a magnetic axis and poles of opposite polarity for producing respectively thereat magnetic fields of corresponding opposed polarity, means for rotatably mounting said permanent magnet adjacent to and in alignment with said one end of said core of the electromagnet, the electric coil of the electromagnet upon energization thereof in one direction or the other causing the magnetic fields produced at said one end of the core thereof to react with the magnetic fields of the permanent magnet to rotate the permanent magnet between substantially opposite angular positions, an indicating element having contrasting appearing surfaces on opposite sides thereof secured to said permanent magnet for rotation therewith, the improvement wherein corresponding indicating elements and associated permanent magnets in the aligned groups of indicating devices are pivotably supported on a common pivot pin, each pivot pin being supported by means providing aligned pivot pin-receiving apertures, each pivot pin being supported in said apertures for axial insertion or removal, and means for retaining each pivot pin in said aligned apertures comprising laterally projecting means near one end of each pivot pin which prevents axial inward movement of the pivot pin and a swivel mounted member bearing against said one end of each pivot pin to prevent axial outward movement of said pivot pin.

* * * * *